US006690287B2

(12) United States Patent
Jette et al.

(10) Patent No.: US 6,690,287 B2
(45) Date of Patent: Feb. 10, 2004

(54) WARNING SIGN SYSTEM FOR ENTERING AND EXITING GARAGE DOORS AND ENTRANCES

(76) Inventors: Gaetan Jette, 1390 Danemark, Mascouche, Que. (CA), J7L 4E7; Renee Chartier, 1390 Danemark, Mascouche, Que. (CA), J7L 4E7

( * ) Notice: Subject to any disclaimer, the term of this patent is extended or adjusted under 35 U.S.C. 154(b) by 85 days.

(21) Appl. No.: 10/107,929

(22) Filed: Mar. 28, 2002

(65) Prior Publication Data

US 2002/0140555 A1 Oct. 3, 2002

Related U.S. Application Data

(60) Provisional application No. 60/280,853, filed on Apr. 3, 2001.

(51) Int. Cl.[7] ..... G08B 3/00

(52) U.S. Cl. ..... 340/691.7; 340/932.2

(58) Field of Search ..... 340/691.7, 932.2, 340/815.83, 815.85, 815.86, 815.87; 116/28 R, 319; 292/240, 242, DIG. 36; 318/266, 286, 460, 468

(56) References Cited

U.S. PATENT DOCUMENTS

| | | | | | |
|---|---|---|---|---|---|
| 3,911,267 | A | * | 10/1975 | Kiehn | 362/282 |
| 4,872,632 | A | | 10/1989 | Johnson | 248/332 |
| 5,208,586 | A | * | 5/1993 | Friberg et al. | 340/932.2 |
| 5,409,191 | A | | 4/1995 | Wenmaekers | 248/317 |
| 5,412,297 | A | * | 5/1995 | Clark et al. | 318/468 |
| 5,529,274 | A | | 6/1996 | Anderson et al. | 248/329 |
| 5,832,865 | A | * | 11/1998 | Harmel | 116/28 R |
| 6,547,292 | B1 | * | 4/2003 | Keller | 292/242 |
| 6,568,454 | B1 | * | 5/2003 | Mullet et al. | 160/188 |

FOREIGN PATENT DOCUMENTS

| | | | |
|---|---|---|---|
| CA | 2015205 | 6/1995 | E05F/15/10 |
| CA | 2312311 | 6/2000 | G08B/21/18 |

* cited by examiner

*Primary Examiner*—Van Trieu
(74) *Attorney, Agent, or Firm*—Mila Shvartsman

(57) ABSTRACT

A safety system for entering and exiting garage doors and entrances comprises a warning sign adapted to be placed by an attachment cable at a primary line of sight of a driver of a truck during lowering and raising movement of the door. A delay circuit is provided to facilitate a movement of the sign in such a manner that the sign will always appear first in the primary line of sight of the driver to eliminate a possibility of collision between the truck and the door. A moving mechanism is adapted to lower the sign into an operational position and provided to keep the sign in non-operational retracted position when the door is completely open to ensure clearance for moving truck. The warning sign is activated by a warning sign activating device such as a motor-driven assembly. The door is activated by a door detector adapted to transmit signal to a door control panel operating the movement of the door by a door motor.

25 Claims, 8 Drawing Sheets

WARNING SIGN SYSTEM FOR ENTERING AND EXITING GARAGE DOORS AND ENTRANCES

CROSS-REFERENCE TO RELATED APPLICATIONS

This application is claim the benefit of a Provisional Application No. 60/280,853 filed on Apr. 3, 2001.

The present invention is related to a safety system and more particularly to a warning sign safety systems for entering and exiting garage doors and entrances.

There is known Canadian Patent 2,015,205 related to a safety system to exiting garage doors having a door operator with a main control circuit, electrical motor and a reversible drive train, wherein the main control circuit provides one of four modes of operation of door opening, door stopped open, door closing and door stopped closed.

There is also known Canadian patent 2,312,311 related to a garage door status indicator kit comprising a sensor for emitting an output signal if the garage door is open, an indicator means mountable on the wall in the garage interior for receiving the output signal and power source connecting means to connect the sensor and indicator.

There is also known U.S. Pat. No. 5,529,274 related to a remote control motor-driven drum to wind and unwind a cord which holds a self-balancing sign suspension system, wherein the motor, which is reverable, is remotely controlled either by wires leading between the motor and a switch, or by radio control.

BACKGROUND AND OBJECT OF THE INVENTION

There is a continuous problem in small and large warehouses with one or many garage doors: the doors are frequently damaged by big vehicles such as trucks, lift trucks, fire trucks or buses as the vehicles go through the doors. According to unpublished statistics, annual repair bills for this damage may run from $250,000 to over $1 million per warehouse. These doors can be located in such places as municipal warehouses or distribution points of multi-national soft-drink and breweries all over North America. Besides, the damage is not only done to the doors, but to the trucks as well; each accident could cost around $2,000.00 per truck. Considering the fact that, on average, 30 to 100 accidents are registered per year for each large warehouse, this cost must be multiplied accordingly.

In addition, if the warehouse is located in a cold climate where, during the winter, the temperature could easily fall below −20° C. (12° F.) it is necessary to use standby heating systems to maintain the proper ambient indoor temperature (at least at 15° C.) to prevent cold air from spoiling the stored goods until the damaged door is repaired. In general, it may take 2–3 days to fix the damaged door, and the owner of the warehouse is forced to spend substantial funds for the additional heating of this area of warehouse.

The reason the vehicles cause damage to the doors is due to the fact that when crossing the door entrance, whether going inside or outside, the driver's primary line of sight is usually in front of him to make sure that he does not hit a pedestrian. Commonly in the industry, there are red/green warning lights controlled by different types of vehicle detectors connected to a control panel. Detectors, such as photocells, magnetic activators or other types, are provided to see the vehicle to activate the door to open. While the door is still not completely open, the red light is "on" to keep the driver from moving. The light turns green only when the door is completely open, indicating that the driver is free to pass without any restriction.

However, very often the driver does not pay attention to these red/green lights because they are placed not in his primary line of sight in front of him because the warning lights are usually installed on one or both sides of the garage door. This is a secondary line of sight of the driver. Another reason for such accidents is due to daylight: when the driver is exiting the garage during the day, it is darker inside than outside; the daylight blinds the driver, and he has difficulty seeing any warning signals. At many locations, vehicles are sensed when they are less than 10 feet from the door. At 5 km/hour, the driver does not have enough reaction time to stop before crashing into the door. Also, if the driver is in the middle of a 25-foot wide door and it starts to close, he will hardly see the warning lights on the side of the entrance. Some light systems are activated by a switch that needs a 6" travelling distance from the door before the light turns red.

The object of the present invention is to eliminate this problem and to substantially reduce expenses caused by those accidents.

BRIEF SUMMARY OF THE INVENTION

The present invention uses an innovative system provided to hold a warning sign that will be lowered down to be suspended in front of the truck at the driver's eye level. Such advantageous positioning of the warning sign in the primary line of sight will be definitely seen by the driver and will warn him that the door is not completely open. The warning sign may be activated by any kind of detectors. The same detector may be used for the activation of the garage door as well. The warning sign is lowered when the door starts to close, and stays there while the door is opening. When the door is completely open, the warning sign will be raised, thus allowing the driver to exit. Neither the warning sign nor the door will be lowered as long as the vehicle is in the vicinity of the door to eliminate accidental damage to the door. Once the door entrance is free, the warning sign will go down, and only when it is completely down will the door start to close. Optionally, it is possible to install a special relay to provide an additional delay right after the sign is down to increase the reaction time for the driver before the door will start to close. As a result, the warning sign will be suspended in the primary line of sight of the driver in case the door will start to close or is not completely open, thus giving the driver more time to react.

DETAILED DESCRIPTION OF THE INVENTION

Figure 1:
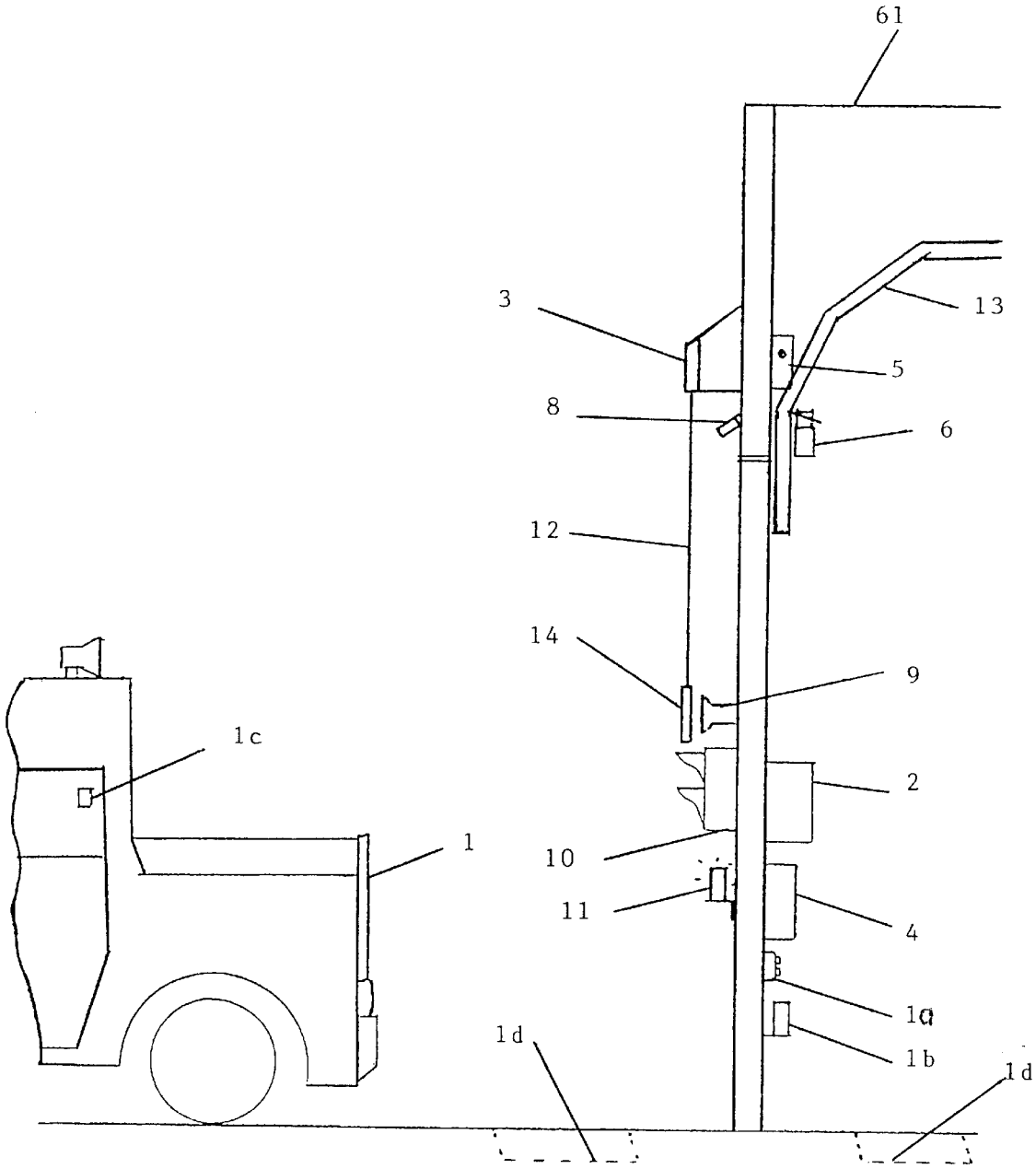
FIG. 1 shows a schematic block-diagram of the warning sign system according to the present invention.

Referring now to the drawings, FIG. 1 shows a schematic block-diagram of the warning sign system of the present invention comprising various vehicle actuators, such as detectors and activators provided for both functions: to detect vehicles to send a command to activate garage door 13 and then to activate a warning sign system of the present invention. It must be emphasized that it is possible to use any of known detectors or activators for the purpose of the present invention, such as a push button (1*a*), photocell or reflective beam (1*b*), remote control (1*c*) installed on a vehicle or truck 1 or a magnetic floor detector (1*d*) facilitating the same function. The detectors 1*b* or 1*d* and activators 1*a* or 1*c* are connected by any means to a door control panel 4 to activate a door motor 5. In this case, door control panel 4 may be relay logic, PLC electronic circuit board, automatic system or any other means used for the same function. Detectors 1*b* or 1*d* and activators 1*a* or 1*c* are also connected a control panel 2 of the warning sign system, which could also be relay logic, electronic circuit board, automatic system or any other means. Control panel 2 of warning sign system is connected to a warning sign motor 3 activating lowering or rising of a warning signal 14 attached to the motor 3 by different means, such as system of cables 12. Door entrance is provided with a detector 6 provided to completely close an opened door 13 and sensor or photocell 8. There may also be installed additional alarm means in the vicinity of the door, such as warning lights 10, alarm siren 9 and stroboscopic lights 11. Elements 8, 9, 10 and 11 are optional and can be installed inside or outside the garage entrance.

In operation, when detectors 1*b* or 1*d* or activators 1*a* or 1*c* detect vehicle 1 approaching the door entrance, they send a signal to door control 4 to open the door 13. This signal will be intercepted by control board 2 of warning sign system to activate the motor 3 of the warning sign system. The motor 3 will activate sign 14 to be lowered down. As soon as the sign 14 will go down, the signal from door control 4 delayed by a predetermined time by a signal from control board 2 activating the motor 3, will activate the door motor 5 to close the door 13. Optionally, the sign 14 may already be down even before the detectors 1*b* or 1*d* or activators 1*a* or 1*c* are activated. As soon as door 13 is completely up, the sign 14 will be raised up and warning light 10 will turn "green". When there is no vehicles in the vicinity of the door 13, activators 1*a* or 1*c* will send a signal to the door control board 4 to close the door 13. This signal will be intercepted by the control board 2 of the warning sign system to activate the sign 14 to start lowering by means of the motor 3 of the warning sign system. The warning light will turn "red". As soon as the sign 14 starts lowering down, the signal from door control 4, delayed by a delay means will activate the door motor 5 to close the door 13. In this case the delay means could be a relay or any other similar electric delay system which may be incorporated into the door control panel 2 or the warning sign control panel 2 will facilitate a delay on a predetermined period of time necessary for the warning sign to be lowered down completely before the door will start to close. If vehicle 1 arrives at the entrance when the door 13 is still up and the sign 14 is already down, the door 13 will stay up and sign 14 will also go up. In case the door 13 starts to close and sign 14 is already down, door 13 will again go up, and as soon it is up, the sign 14 will also go up. In case vehicle 1 is very close to the door and neither warning sign system nor door control system are able to warn the driver, another safety feature, such as sensor or photocells 1*b* or 8, may be activated together with stroboscopic lights 11 and alarm siren 9 to additionally warn the driver. When door 13 is completely closed, the sign 14 may stay down or go back up until the next vehicle comes to the door. Warning light 10 is always "red" until door 13 is open and sign 14 is up. In case vehicle 1 is backing up towards the entrance and the driver is not able to see the warning sign 14, detectors 1*b* or 1*d* or sensor 8 will activate the sound alarm 9 to prevent accident. It must be emphasized that the warning sign 14 of the present system is always lowered when the door 13 is in movement, or a few second before the door starts to close.

Present system uses a reversible motor provided to lower the warning sign 14. There are numerous possibilities of designing the warning sign arrangement to provide the same result which will cover the broadest scope of the present invention. The invention utilises an innovative system provided to support the sign 14. In some of the embodiments of the present invention, such system comprises a motor-driven drum as a winder to wind and unwind a cord or a number of cords or straps supporting the sign 14. The sheaves or the attachment to the sign 14 are not important, as they receive the cord and lead it from the motor-driven drum to the warning sign, wherein the motion of the drum serves to raise and lower the warning sign. The user may fix the motor-driven system of the present invention indoors or outdoors. The speed, delay and duration are programmable or manufactured parameters, and can vary. The motor 3, which is reversible, is remotely controlled either by wires leading between the motor and a switch, or by radio automated system, electronic circuit or electrical (relay logic) systems provided to always raise the warning sign 14 once garage door 13 is completely open and to lower it before the garage door 13 starts to close or open. A shelter (not shown) can be provided to protect the system from the elements.

Figure 2:
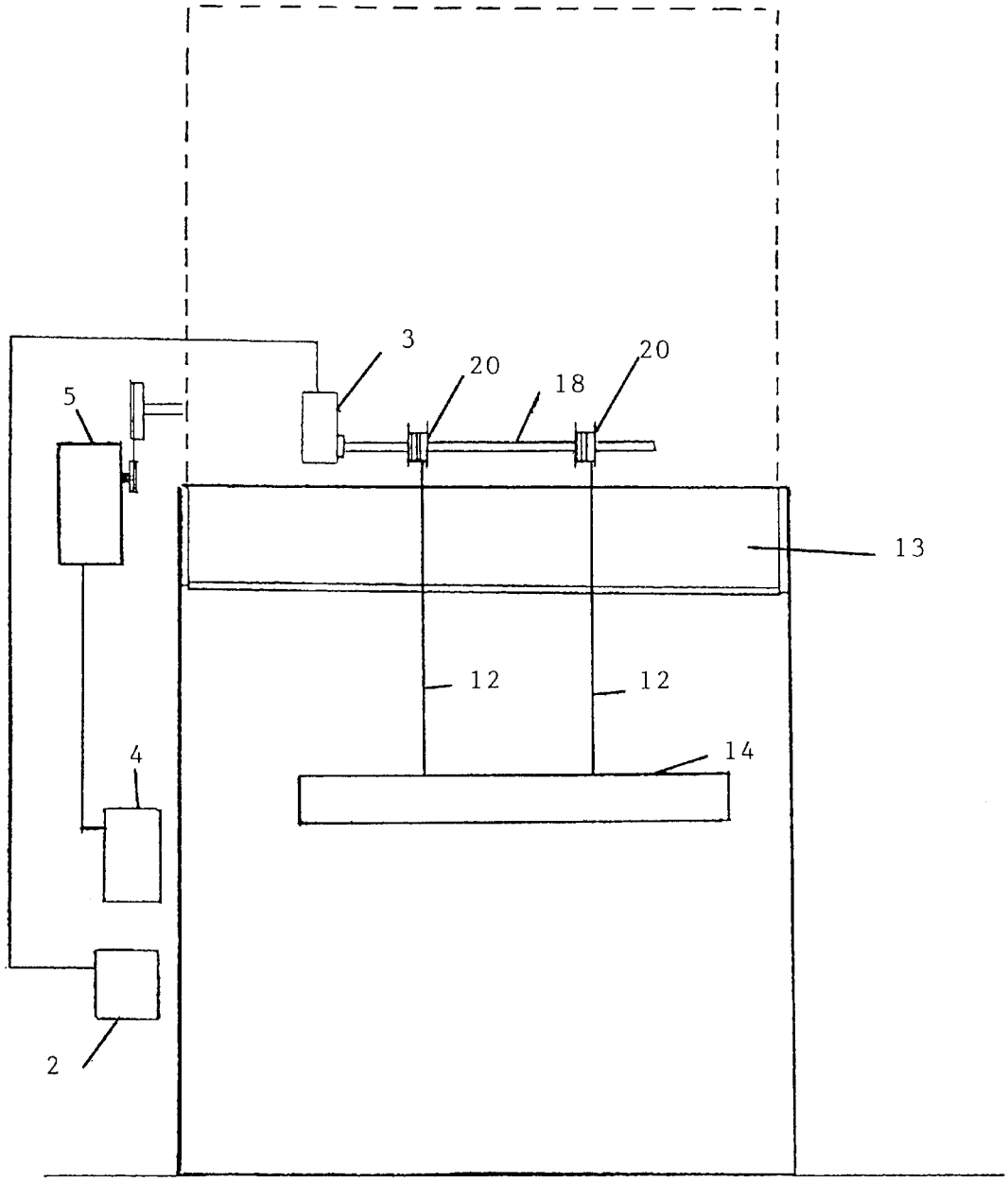
FIG. 2 shows a warning sign suspension system according to the first embodiment of the present invention.

FIGS. 2–7 shows different modifications of the motor-driven portion of the warning sign system of the present invention. FIG. 2 shows a first embodiment comprising a motor 3 connected to a rotatable shaft 18. Warning sign 14 is suspended on shaft 18 by means of pair of cables 12. Motor-driven drums 20 are adapted to raise or lower sign 14 into an operative position. All system is fixed to the support by means of bearings and bracket (not shown) or any equivalent means.

Figure 3:
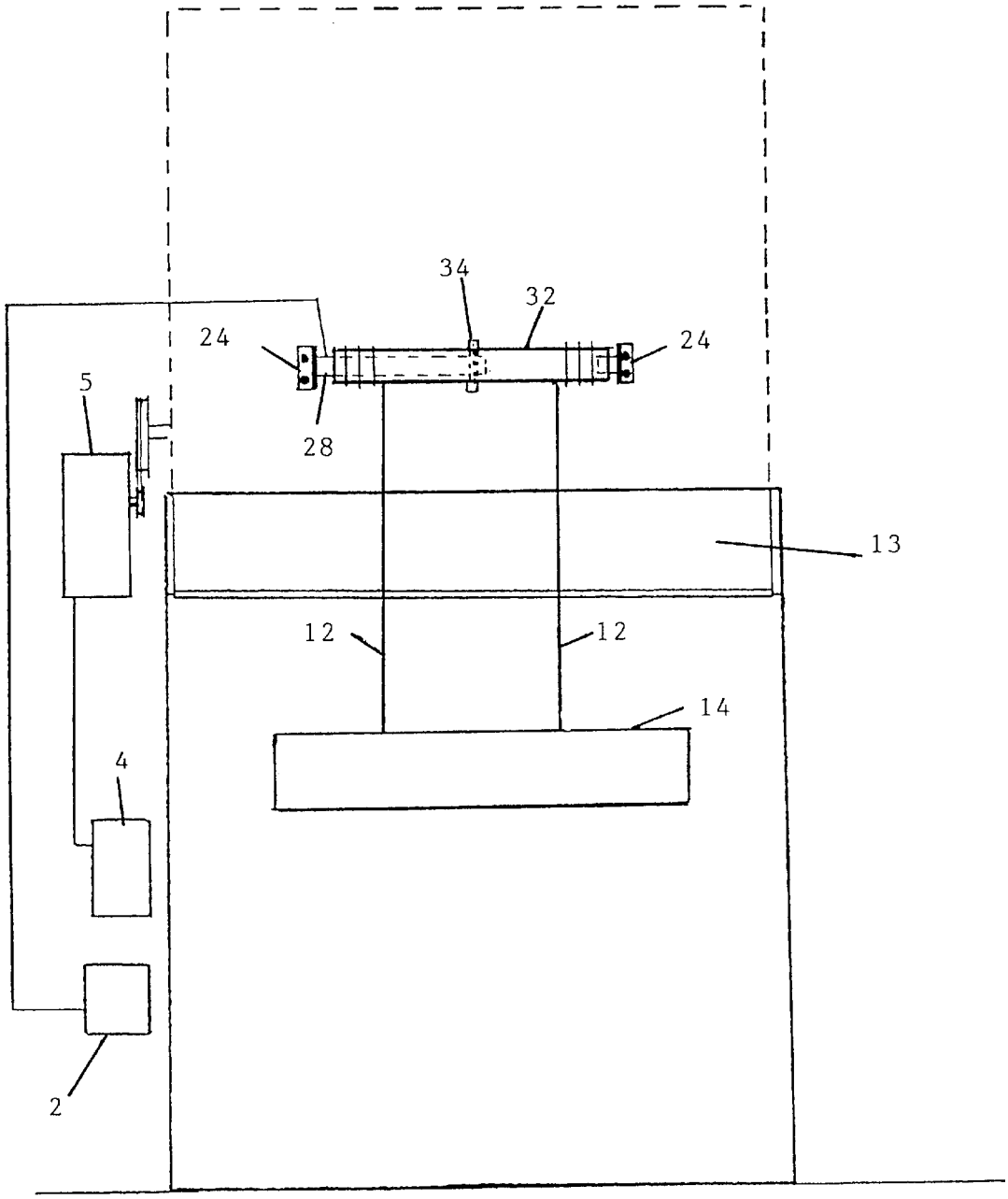
FIG. 3 shows a warning sign suspension system according to the second embodiment of the present invention.

FIG. 3 shows a second embodiment of the present invention comprising a tubular motor 28 connected to a drum 32 of a larger diameter placed over and connected to the motor 28 by means of a pin 34. Rotation of the motor 28 transferred to the drum 32 is provided to wind or unwind cables 12 to which warning sign 14 is attached.

Figure 4:
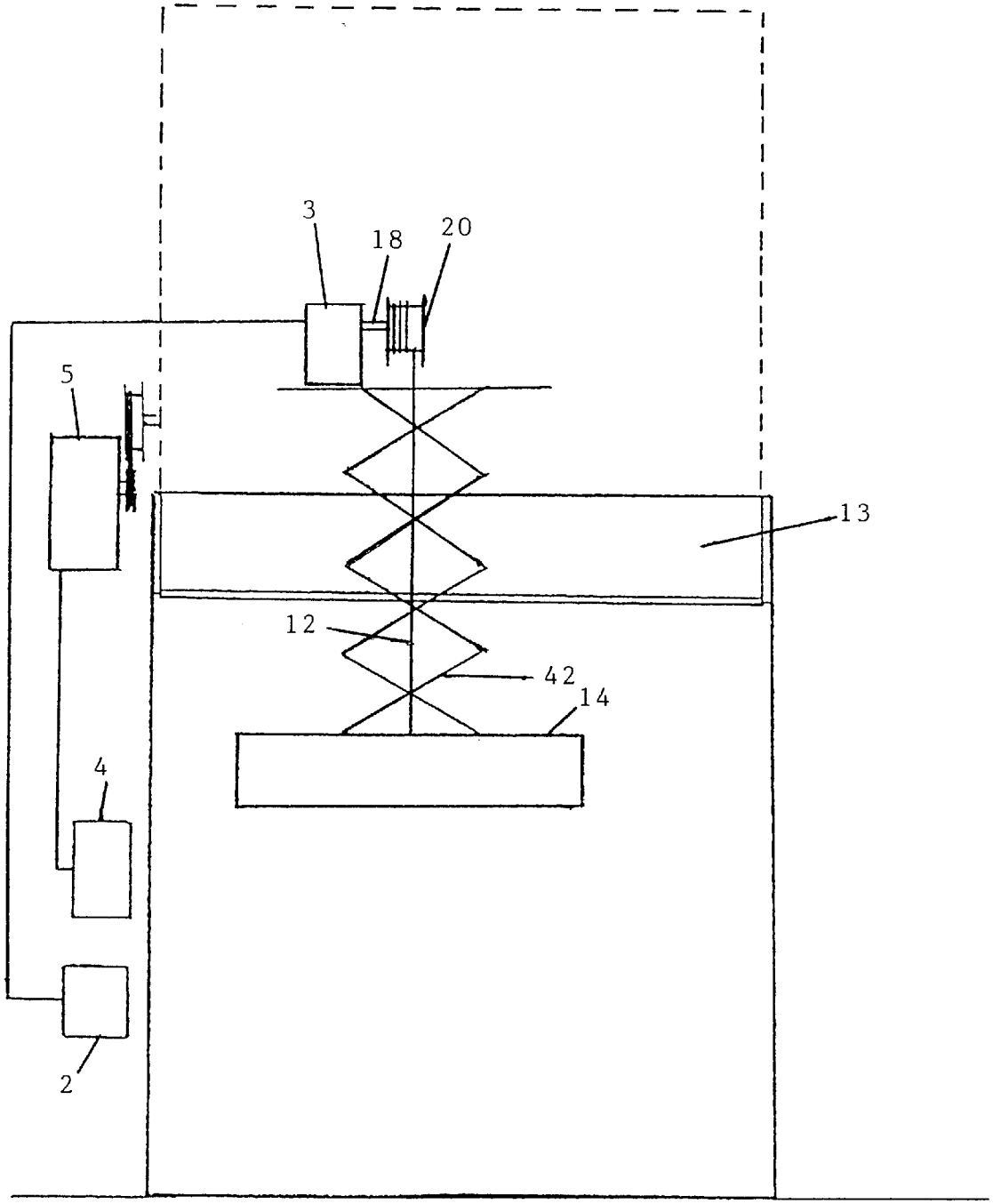
FIG. 4 shows a warning sign suspension system according to the third embodiment of the present invention.

FIG. 4 shows a third embodiment of the present invention comprising a motor-driven assembly mounted to an upper edge of the door entrance and including the motor 3 connected to the shaft 18 supporting a drum 20 by means of bearings (not shown). Warning sign 14 is suspended by means of cable 12 and a metal lazy-tongs system 42. All sign system is attached to the support by means of bracket (not shown) or any other means.

Figure 5:
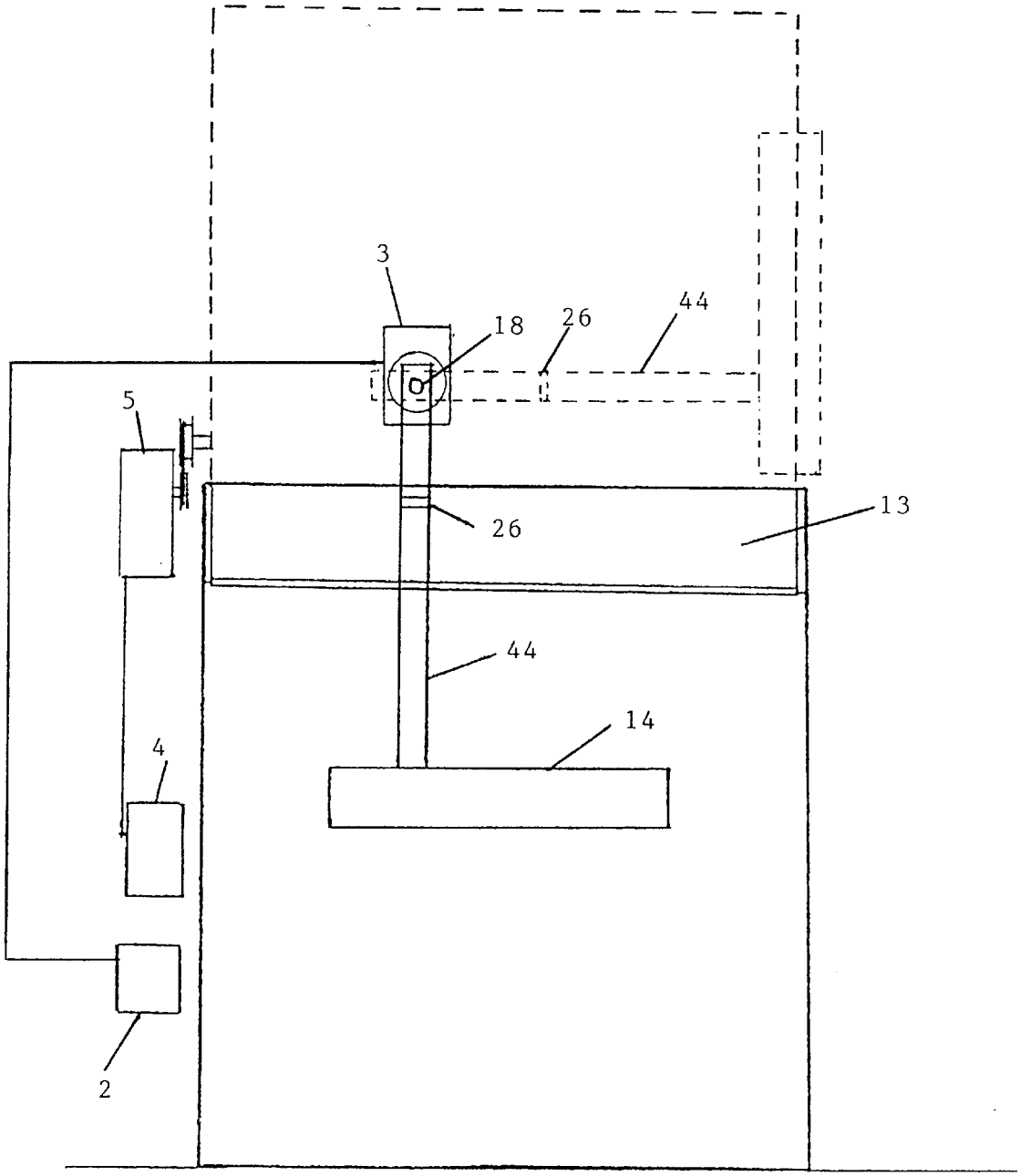
FIG. 5 shows a warning sign suspension system according to the fourth embodiment of the present invention.

FIG. 5 shows a fourth embodiment of the present invention comprising a motor 3 connected to a shaft 18 supporting a warning sign 14 by means of a rigid plate 44 pivotally connected to shaft 18. A joint 26 mounted on the rigid plate 44 is provided to prevent rigid board 44 from being damaged if hit by vehicle 1. The motor 3 is adapted to pivot the rigid plate 44 between an operable and non-operable positions, wherein said rigid plate 44 is completely retracted to clear the door entrance.

Figure 5A:
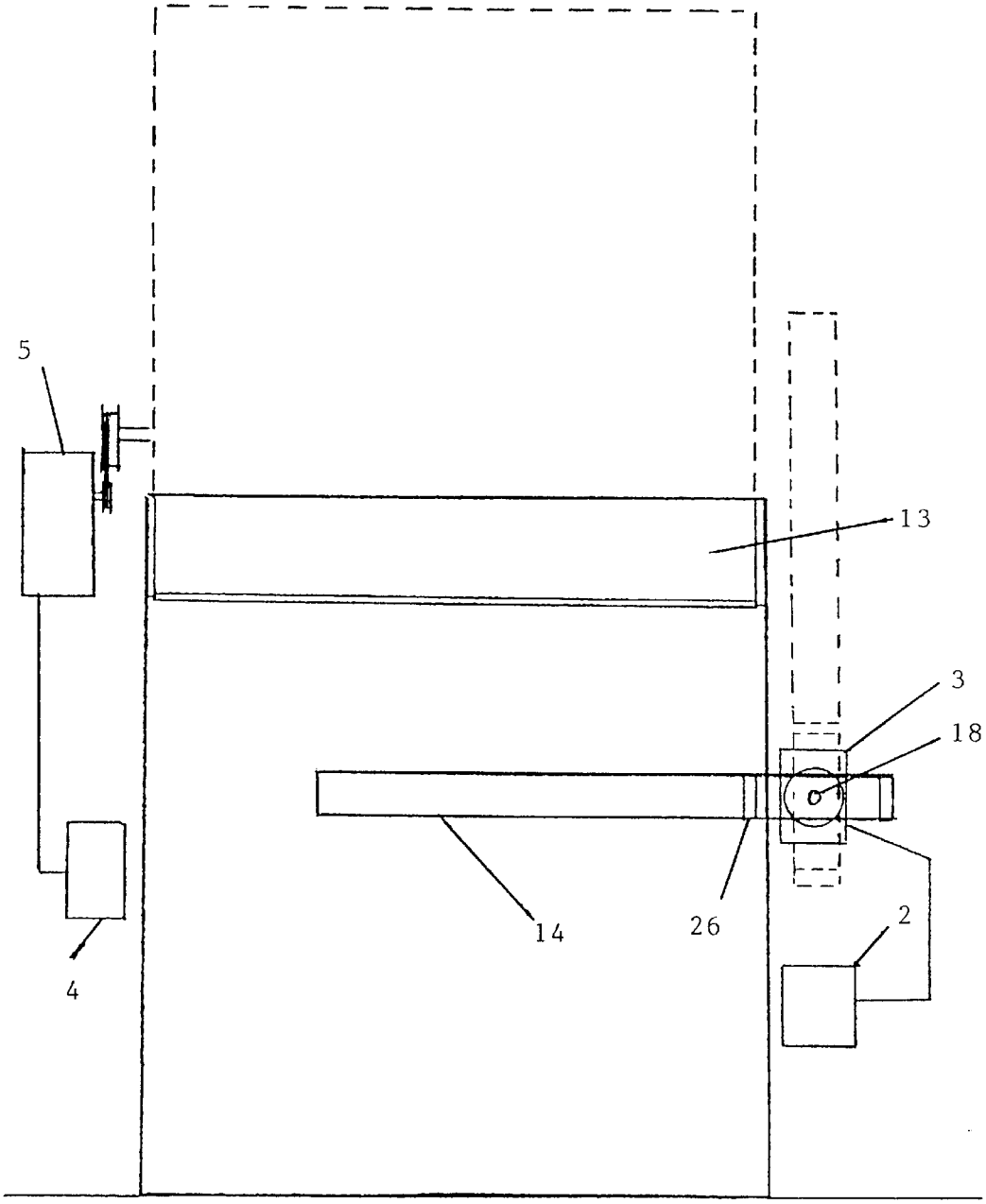
FIG. 5A shows another modification of the embodiment of FIG. 5.

FIG. 5A is another modification shown of FIG. 5, wherein all motor-driven system supporting the warning sign 14 is mounted on a side of the door entrance. In this embodiment the dimensions of the sign 14 can be larger that the width of the garage entrance to facilitate a better visibility of the sign 14 in case the vehicle 1 is backing up towards the entrance.

It must be emphasized that embodiments of FIGS. 5 and 5A may be installed inside or outside of the door entrance or exit without departing from the scope of the present invention.

Figure 6:
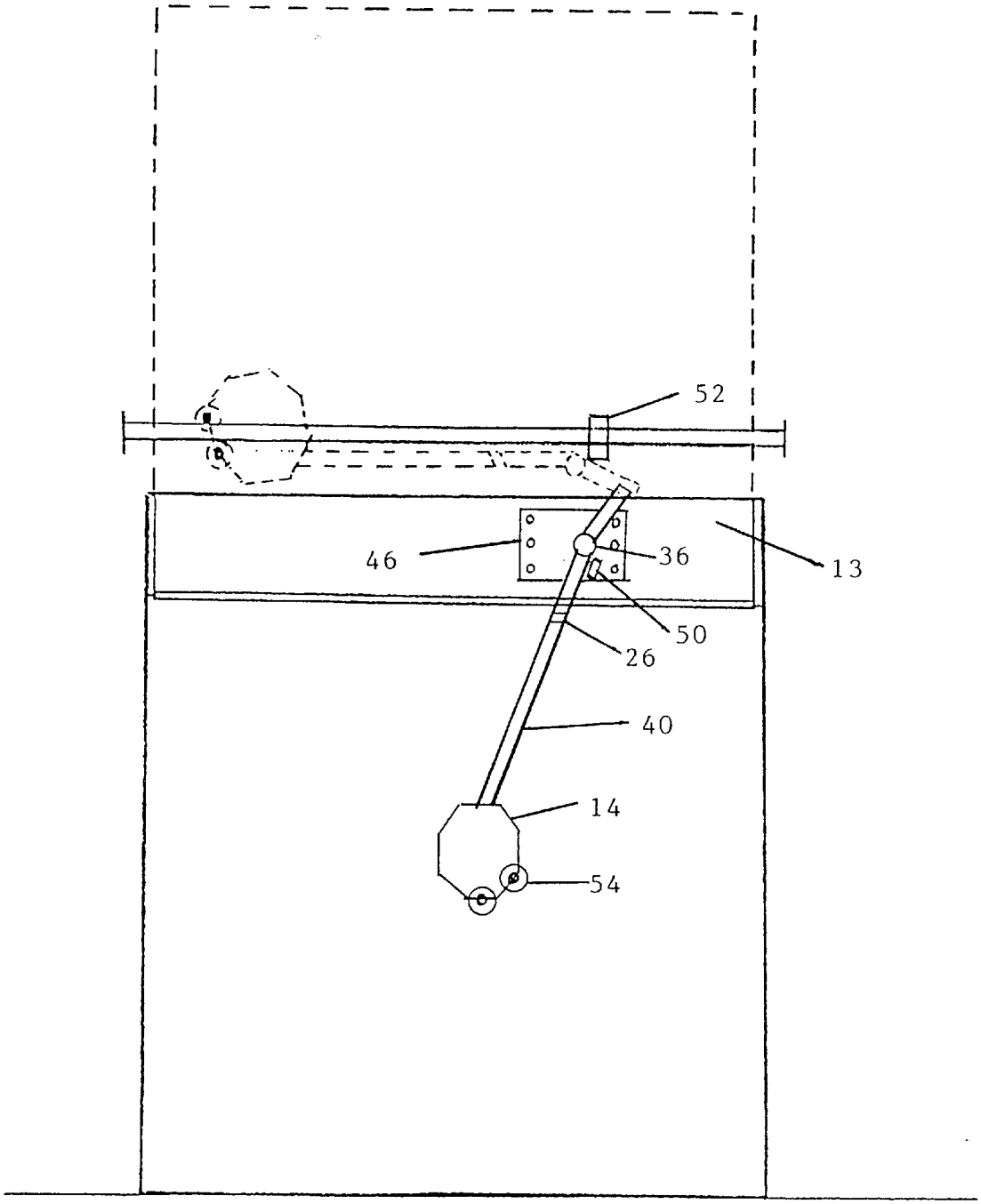
FIG. 6 shows a warning sign system according to the fifth embodiment of the present invention.

FIG. 6 shows a fifth embodiment of the present invention comprising a mechanical version of the warning sign system to be fixed to the bottom of the door 13 and comprising a sign 14 attached to a pivoting arm 40 adapted to be pivoted by means of pivot 36 mounted on bracket 46 connected to the lower edge of the door 13. Pivotal movements of the arm 40 are restricted by a first stopper 50 provided to maintain the angle of the arm 40 when the door 13 is between opened and closed position and a second stopper 52 mounted on the upper frame of the door entrance to facilitate the pivoting upward movement of the arm 40 when the door 13 is open. Sign 14 is also provided with a set of wheels 54 mounted around a lower portion of said sign 14, to facilitate rolling movement of the sign 14 in contact with the ground while the door 13 is about to be closed and the sign 14 is pivoted into retracting position. A joint 26 located on the pivoting arm 26 is provided to prevent the sign 14 from being broken in case of an accidental hit by the vehicle 1.

Figure 7:
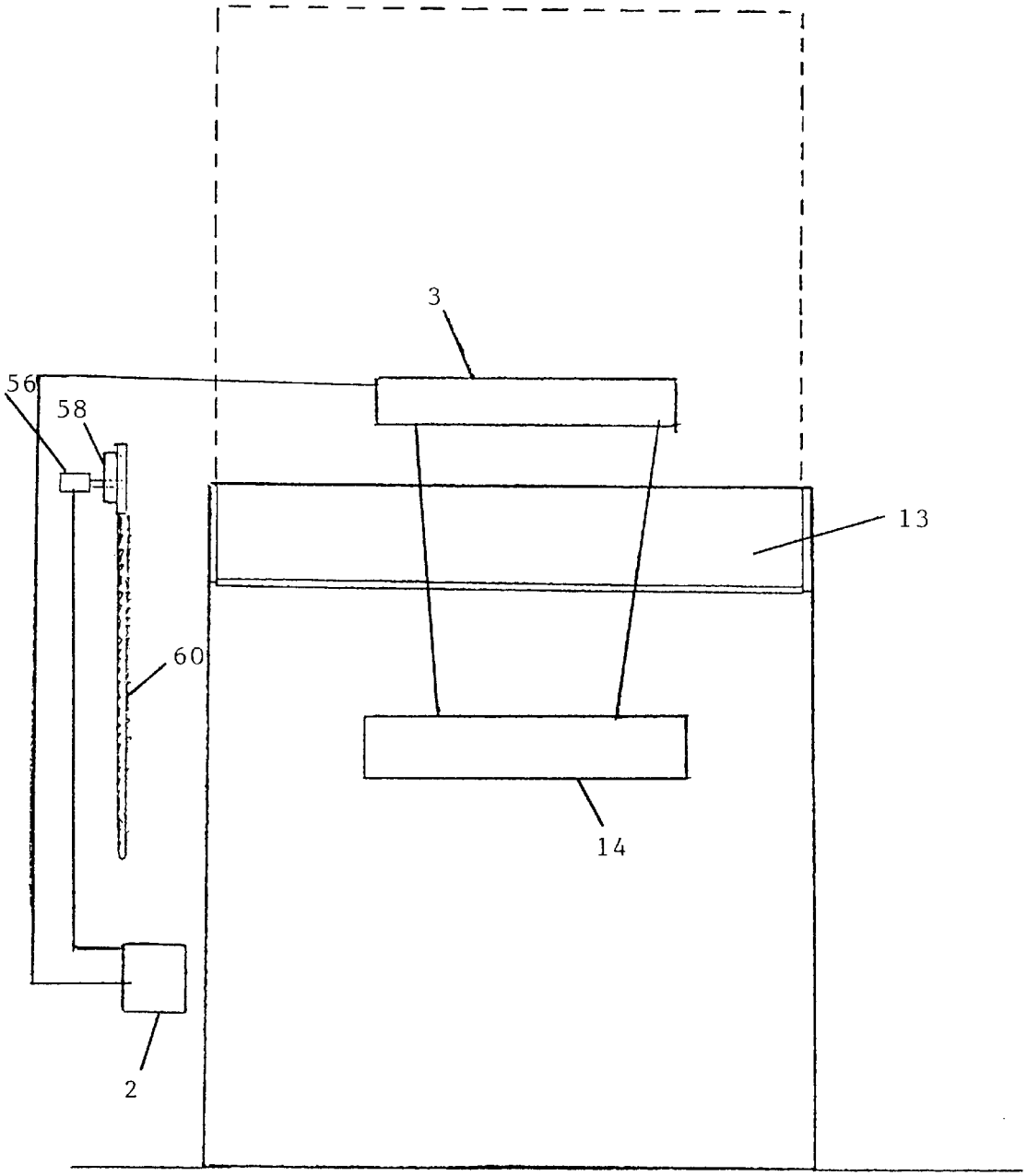
FIG. 7 shows a warning sign system according to the sixth embodiment of the present invention.

FIG. 7 shows a sixth embodiment of the present invention comprising a solenoid 56 or any locking device connected to mechanical drums 58 provided with cables or chains 60 to open the door 13 manually. The solenoid 56 is provided to prevent the door 13 from being opened or closed in case sign 14 is not down. A warning sign control 2 is interconnected with the solenoid 56. Once the sign 14 is down by means of a motor 3, the operator will be free to open or close the door 13. In this embodiment, to open or close the door, the sign 14 has to be lowered down before the solenoid or locking device 56 will automatically allow any movements of the door 13.

Thus, it can be seen that the objects of the present invention have been satisfied by the structure presented hereinabove. While in accordance with the Patent Statutes, only the best mode and preferred embodiments of the present invention have been presented and described in detail, it is to be understood that the invention is not limited thereto or thereby. Accordingly, for an appreciation of the true scope and breadth of the invention, references should be made to the following claims.

What is claimed is:

1. Safety system for entering and exiting garage doors and entrances comprising:

a warning sign adapted to be placed by an attachment means at a primary line of sight of a driver of a truck during lowering and raising movement of said door;

a delay means provided to facilitate a movement of said sign in such manner that said sign will always appear first in the primary line of sight of said driver to eliminate a possibility of collision between said truck and said door;

a moving means adapted to lower said sign into an operational position and provided to keep said sign in non-operational retracted position when said door is completely open to ensure clearance for moving truck.

2. Safety system according to claim 1, wherein said warning sign is activated by a warning sign activating means.

3. Safety system according to claim 2, wherein said warning sign moving means is a motor-driven assembly.

4. Safety system according to claim 3, wherein said door is activated by a detector adapted to transmit signal to a door control panel operating the movement of said door by means of a door motor.

5. Safety system according to claim 4, wherein warning sign activating means is a warning sign control panel, said warning sign control panel is adapted to monitor signals sent from said detector to said door control panel.

6. Safety system according to claim 5, wherein the signal transmitted from said door control panel to said door motor is intercepted by said warning sign control panel.

7. Safety system according to claim 6, wherein said door is lowered down by a detector adapted to send signal to said door control panel.

8. Safety system according to claim 7, wherein said signal is intercepted by said warning sign control panel activating the warning sign to be lowered down before said door is closed.

9. Safety system according to claim 3, wherein said sign is attached to said motor-driven assembly by a system of cables connected to a respective set of drums mounted on a shaft.

10. Safety system according to claim 3, wherein said sign is attached to said motor-driven assembly by a cable connected to a drum and a lazy-tongs system.

11. Safety system according to claim 3, wherein said sign is attached to said motor-driven assembly by a rigid plate pivotally connected to a shaft.

12. Safety system according to claim 3, wherein said sign is attached to said motor-driven assembly by cables connected to a drum rotatable by a tubular motor mounted within said drum.

13. Safety system according to claim 3, wherein said sign is fixed to a side of said entrance.

14. Safety system according to claim 3, wherein said warning sign is attached to said motor-driven assembly by a pivoting arm adapted to pivot said sign into a retracting position.

15. Safety system according to claim 3, wherein said warning sign motor-driven assembly is a motor driven drum adapted to wind and unwind the attachment means of said sign.

16. Safety system according to claim 2, wherein said sign is attached to a lower edge of said door by a pivoting arm adapted to be pivoted around a pivot mounted on said door, and wherein pivoting movement of said arm is restricted by a first stopper provided to maintain the angle of the arm when said door is between an open and a closed position and a second stopper mounted to an upper frame of the entrance to facilitate the pivoting upward movement of said arm when the door is opening.

17. Safety system according to claim 2, wherein said warning sign activating means is a locking element connected to a set of drums provided with cables facilitating manual operation of the door, and wherein said locking device is provided to prevent the door to be opened or closed in case the sign is not completely down.

18. Safety system according to claim 1, wherein said sign is fixed above said door.

19. Safety system according to claim 1, wherein said door is provided with an additional alarm means installed in the vicinity of said door to increase the reaction time for said driver before the door will start to close or is not completely open.

20. Safety system according to claim 6, wherein said delay means is activated by said door control means at a predetermined delay period set by the signal sent from said sign control panel.

21. Safety system according to claim 20, wherein said warning sign delay means is an electric delay system provided to allow an additional delay time right after said sign is down to increase the reaction time for the driver before the door will start to close.

22. Safety system according to claim 1, wherein said door is provided with a sensor adapted to give additional warning signal to the driver in case said truck is very close to the door.

23. Safety system according to claim 1, wherein said sign stays down when said door is completely closed.

24. Safety system according to claim 1, wherein said sign stays up when said door is completely closed.

25. Safety system according to claim 1, wherein the dimensions of said sign are larger than a width of said entrance to facilitate a better visibility of said sign when the truck is backing up towards the entrance.

* * * * *